United States Patent [19]

Saito

[11] 3,949,546

[45] Apr. 13, 1976

[54] ILLUMINATING DEVICE FOR DIGITAL DISPLAY WRISTWATCHES

[75] Inventor: Toshiaki Saito, Chino, Japan

[73] Assignee: Kabushiki Kaisha Suwa Seikosha, Tokyo, Japan

[22] Filed: Mar. 13, 1974

[21] Appl. No.: 450,706

[30] Foreign Application Priority Data

Mar. 13, 1973 Japan ..... 48-28509

[52] U.S. Cl. ..... 58/50 R; 58/23 R; 58/85.5

[51] Int. Cl.[2] ..... G04B 19/34

[58] Field of Search ..... 58/50 R, 23 R, 85.5; 240/6.43

[56] References Cited

UNITED STATES PATENTS

| | | | |
|---|---|---|---|
| 2,167,463 | 7/1939 | Regester | 58/50 R X |
| 2,358,422 | 9/1944 | Springer | 58/50 R |
| 2,895,038 | 7/1959 | Whiston | 58/50 R X |
| 2,915,577 | 12/1959 | Bronstert | 58/23 BA X |
| 2,974,474 | 3/1961 | Wegner | 58/50 R |
| 3,540,207 | 11/1970 | Keeler | 58/23 R |
| 3,672,155 | 6/1972 | Bergey et al. | 58/50 R |
| 3,712,047 | 1/1973 | Girard | 58/23 R |
| 3,747,322 | 7/1973 | Eckenrode | 58/50 R |
| 3,748,456 | 7/1973 | Brien | 58/50 R |
| 3,788,061 | 1/1974 | Tornquist et al. | 58/50 R |

*Primary Examiner*—L. T. Hix
*Assistant Examiner*—U. Weldon
*Attorney, Agent, or Firm*—Blum, Moscovitz, Friedman & Kaplan

[57] ABSTRACT

An electronic timepiece having a quartz crystal oscillator serving as a time standard, a digital display, and integrated divider and driving circuits for dividing the high-frequency signal from the oscillator circuit into low-frequency timing signals for the direct driving of the liquid crystal display. A light source is disposed proximate the liquid crystal display. A single power source is utilized to energize the oscillator circuit and divider circuits, as well as to provide a voltage sufficient to energize the driving circuit, liquid crystal display and light source.

7 Claims, 2 Drawing Figures

ILLUMINATING DEVICE FOR DIGITAL DISPLAY WRISTWATCHES

BACKGROUND OF THE INVENTION

This invention relates generally to small-sized electronic timepieces having liquid crystal displays adapted to be selectively illuminated by a light source and especially to an electronic wristwatch having a single power source for energizing the timekeeping circuitry and illuminating the light source.

Solid-state electronic timepieces having digital displays are of two types, the light-emitting type, wherein light-emitting diodes (LED) or the like are utilized as display elements or the passive type wherein liquid crystal elements are utilized as the display elements. Those which utilize light-emitting elements have the disadvantage of requiring extremely large amounts of current to drive same and therefore require either a large battery or several large batteries to be incorporated in the timepiece if the display is to be rendered light-emitting for long periods of time. For instance, it would require at least 100 compact button-type batteries to maintain an electronic light-emitting digital display continuously lit for at least a year, the space required to store the batteries rendering the use of such batteries impossible in a small-sized electronic timepiece. To overcome this disadvantage, light-emitting displays are switched on and off when the viewer wants to view the time, a display switch being provided on the wristwatch to allow the light-emitting elements to become energized. Such a use of light-emitting elements is known as the "demand" method. It is appreciated that the demand method is inconvenient to a wearer who is holding packages or other objects in one hand or both hands, as he then cannot determine the time without freeing his hands so as to allow him to actuate the display switch.

Nevertheless, one advantage of light-emitting displays is that the display can be viewed in the nighttime or in very dark places. A passive display, such as one formed of liquid crystals, although providing continuous displays and only utilizing one-ten thousandth the current utilized by a light-emitting display, cannot be read in dark places because it requires a light source to illuminate same. Furthermore, this disadvantage cannot be overcome by providing luminous painted dots, as is done to the dial and hands in a mechanical timepiece, because the use of enough luminous paint to effect a display would exceed acceptable limits of radioactivity and therefore render impossible the use of luminous paint in a passive-type watch.

It has been found effective to utilize a miniature bulb proximate to the liquid crystal display in an electronic wristwatch. However, a second source of energy is required to energize the bulb, and although it would be convenient to utilize a battery in the same manner that a battery is used in addition to a barrel drum as an energy source in conventional mechanical timepieces, such use is not practical in a small-sized electronic wristwatch because of its limited space requirements.

SUMMARY OF THE INVENTION

Generally speaking, in accordance with the invention, a timepiece is provided having a quartz crystal oscillator circuit for producing a high-frequency time standard signal, divider circuit means coupled to the quartz crystal oscillator circuit for producing low-frequency time signals from the high-frequency time standard signal, a liquid crystal display and integrated driving circuit means coupled intermediate said divider means and said display for directly driving the same. A light source is provided proximate the liquid crystal display for illuminating same upon energization thereof. A single power source is further provided and is coupled to the vibrator and driving circuits for the energization thereof. The single battery is further coupled to the light source for providing energy to illuminate same.

Accordingly, it is an object of this invention to provide an improved liquid crystal display wristwatch including an illumination device for the liquid crystal display.

Another object of this invention is to provide an improved electronic timepiece having a passive digital display and an illumination source for lighting same driven by the same power source utilized to energize the timekeeping circuitry.

A further object of this invention is to provide an improved electronic timepiece having a liquid crystal display which is as compact as a conventional mechanical wristwatch.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
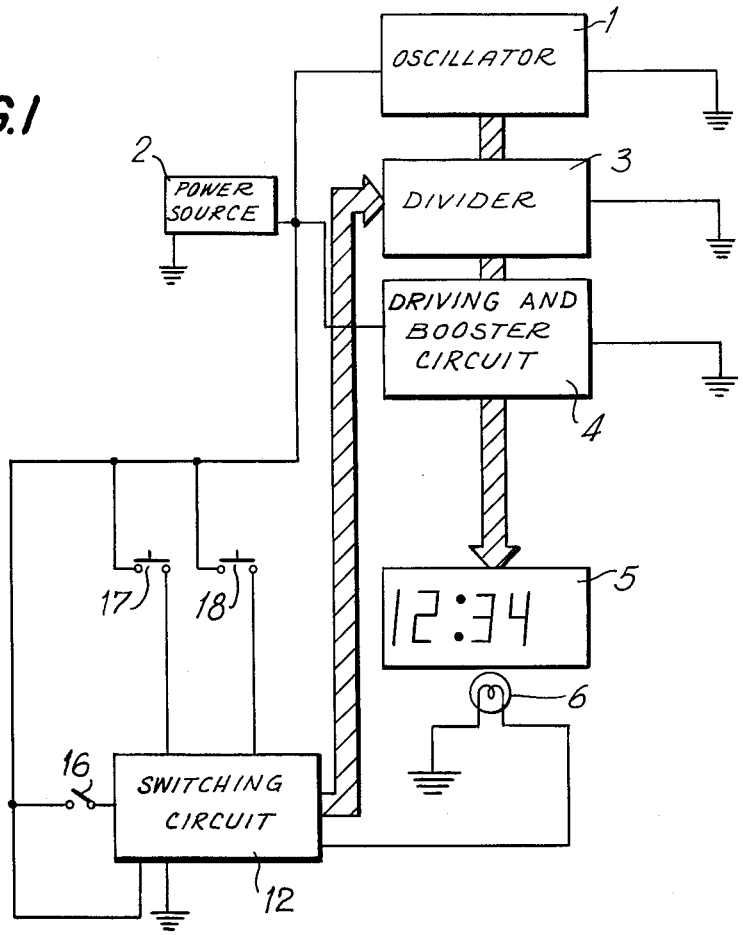
FIG. 1 is a block diagram of an electronic wristwatch constructed in accordance with the instant invention.

Referring now to FIG. 1, an electronic timepiece having a liquid crystal digital display 5 comprised of light-reflection or light-permeation-type elements for displaying numerals representative of hours, minutes and seconds is depicted. Each digit of the display may, by way of example, take the form of a seven-bar display. An oscillator circuit 1, which includes a quartz crystal vibrator, is coupled to an electronic divider circuit 3 for applying high-frequency time standard signals thereto. The electronic divider circuit 3 consists of a multistage divider chain capable of counting seconds, minutes and hours, and producing, as an output, timing signals representative of present time as reflected by the count in the respective divider stages. The divider circuit 3 applies timing signals to driving and booster circuit 4, which circuit is adapted to supply driving signals to digital display 5, which driving signals represent the count of the divider stages.

A switching circuit 12 consists of a logic switching circuit capable of being actuated by a manually operated control switch 16. Switching circuit 12 is coupled to the electronic divider circuit 3 for applying signals thereto and is further coupled to a light source 6 which is disposed proximate to the liquid crystal digital display for illuminating same. Manually operated correction switches 17 and 18 are selectively coupled at a first position of control switch 16 to the electronic divider circuit 3 through switching circuit 12, the correction switches being respectively connected by said switching circuit to the dividing circuits which count the minute and hour signals for the separate correction of the minutes or hours displayed by digital display 5. When the control switch 16 is in its second position, one or more of the correction switches 17 and 18 are connected through switching circuit 12 to lamp 6 for the selective illumination of the lamp. One side of each of switches 16, 17 and 18 is coupled to power source 2 which provides power through switching circuit 12 to illuminate lamp 6 upon the setting of switch 16 in its second position and the actuation of one of said correction switches. The logic switching circuit 12 may take any desired form such as the prior art logic switching circuit exemplified by inverter 19 and AND gates 20 and 21 controlled by switch WC of U.S. Pat. No. 3,795,099 or inverter 31 and AND gates 32 and 33 controlled by switch 30 of U.S. Pat. No. 3,745,761. Power source 2, preferably a battery, is coupled to the oscillator and driving circuit to provide energy therefor. Thus, a single energy source is utilized to energize the timekeeping circuitry and illuminate the light source 6 to render the liquid crystal display viewable in the dark. The booster circuit of driving and booster circuit 4 is provided to step-up the voltage of power source 2 as required to drive liquid crystal display 5.

As depicted in FIG. 1, the use of a single power source to effect a plurality of operations in an instrument is well known, but has not been utilized in small-sized electronic timepieces because of two problems which are common in such timepieces. First, when the capacity of a battery is on the order of 100mAH–17-0mAH, such a small capacity causes the battery to be exhausted in a short period of time. Therefore, in view of the limited battery capacity, the battery will not last for at least a year, a necessary expedient in any electronic timepiece. For example, when a battery is utilized which has a capacity of 150mAH, one-half of the capacity thereof is utilized to illuminate the power source, the remainder being utilized to drive the timepiece, such driving requiring $8\mu$-amps a year.

As is known to one with ordinary skill, a liquid crystal display must be driven by voltages on the order of 3 volts, lower voltages in the neighborhood of 1.3 to 1.5 volts being insufficient to drive same. Although current consumption can be reduced to $8\mu$-amps for driving the oscillator and dividing circuits, the same voltage will not be capable of driving liquid crystal display elements. Therefore, in practicing the instant invention, FE(field effect)-type liquid crystals are utilized because they utilize one-tenth the current utilized by DS(dynamic scattering)-type liquid crystals.

Because DS-type liquid crystals require high driving voltages and consume large amounts of current, it is necessary to utilize two batteries to drive such liquid crystal elements in an electronic timepiece. In contradistinction thereto, FE-type liquid crystals can be driven at voltages as low as 1.5 volts but no greater than 6 volts, the principal feature being that such crystals permit minimal current consumption. Moreover, since the oscillator circuit, divider circuits, and the liquid crystal driving circuit only require a total of $5\mu$ amps, their consumption level is far below $8\mu$-amps. Of course, such a current consumption figure of $5\mu$-amps is only obtainable if all the circuit elements are formed from complementary MOS-IC circuitry and the oscillating circuit is of the inverter type. Moreover, it is noted that a bulb can be illuminated so as to light such a display and will consume approximately 10 milliamps of current. Thus if such a lamp is turned on 30 times a day, for approximately 2 seconds, approximately 60mAH is required to energize same or less than one half the current capacity of the power source is required.

Thus, the circuit depicted in FIG. 1 can be utilized in an electronic timepiece if a three volt Li battery is utilized as the power source, and the liquid crystal display is driven by the supply voltage, the oscillator and dividing circuit being energized by 1.5 volts, such supply voltage of course being reduced or stepped down to the necessary value by suitable circuitry intermediate the power source 2 and the oscillator and divider circuits. In the latter embodiment the booster circuit would not be required.

The second problem in utilizing a single power source in an electronic timepiece is that batteries formed of sodium hydroxide, NaOH have been utilized in electronic timepieces which consume small amounts of current. Since sodium hydroxide solutions are electrolytes of low activity, they are used in order to prevent inferior contacts caused by leakage which causes carbonic compound powder deposits. Nevertheless, NaOH batteries are not able to provide currents as large as several milliamps to illuminate the bulb. It is therefore necessary to utilize a battery having a highly active electrolytic solution such as potassium hydroxide. Accordingly, the circuit of FIG. 1 is practiced by utilizing a battery including a potassium hydroxide solution.

In order to overcome the leakage problem hereinafter discussed, when utilizing a battery having a potassium hydroxide electrolyte, it is necessary to separate the battery completely from the timekeeping elements and provide a corrosion resistant contact therebetween formed of stainless steel having a 2 micron thick layer of gold plated thereon. It is noted that it is also possible to utilize a sodium hydroxide battery with a capacitor coupld in parallel with the battery, the capacitor lengthening the life of the battery by reducing the stress thereon during momentary illumination of the lamp.

Figure 2:
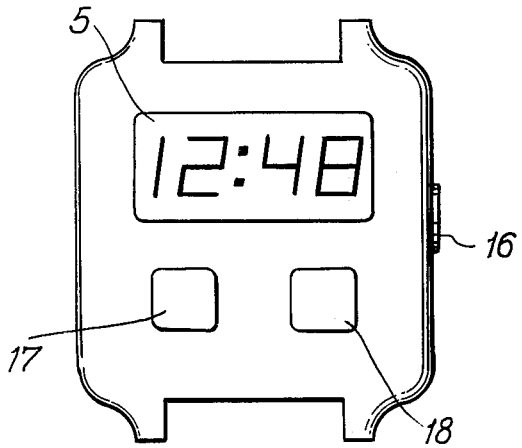
FIG. 2 is a perspective view of an electronic timepiece including a liquid crystal display in accordance with the instant invention.

Reference is now made to FIG. 2 wherein an electronic timepiece utilizing a liquid crystal timepiece for displaying hours and minutes is depicted, the electronic timepiece depicted therein including an hour correcting button 17, a minute correcting button 18, and a control switch 16. The correcting buttons are also utilized as the illuminating switch button. When the control switch 16 is displaced outward, and minute and hour buttons 17 and 18 are actuated to permit correction of digital display 5 upon operation of said minute and hour buttons. When the control switch 16 is in an inward position, time display is not corrected even if the correcting buttons are pushed, instead, pushing buttons 17 or 18 effects illumination of a lamp as illustrated in FIG. 1, so that time displayed can be viewed under darkened conditions. It is appreciated that a third button and correction switch can be provided to correct seconds. However, an increase in the number of exterior operable members such as push buttons increases the manufacturing costs. Moreover, the small size of the electronic timepiece makes the operation thereof cumbersome if too many buttons are included and further makes it more difficult to have the watch maintained water-resistant. However, it is noted that the number of buttons is maintained at a minimum since correcting switches and control switches are required in all electronic timepieces, and the correcting buttons are used for a second purpose as a light bulb switching button.

It is noted that the instant invention limits current consumption thereby rendering useful a single battery and a solid state electronic timepiece having a passive electronic display, the display being easily read in the dark yet allowing the electronic timepiece to be small sized. Thus, the size of the timepiece does not have to be large to provide enough space for a single power source as was required in conventional timepieces.

The invention accordingly comprises the features of construction, combination of elements, and arrangement of parts which will be exemplified in the construction hereinafter set forth, and the scope of the invention will be indicated in the claims.

It is also to be understood that the following claims are intended to cover all of the generic and specific features of the invention herein described, and all statements of the scope of the invention which, as a matter of language, might be said to fall therebetween.

What is claimed is:

1. An electronic timepiece comprising quartz crystal oscillator means producing a high frequency time standard signal; divider circuit means for producing a low frequency time signals in response to said high frequency time standard signals; liquid crystal display means for digital display of time; driving circuit means intermediate said divider circuit means and said liquid crystal display means for applying driving signals to said display means in response to said time signals applied thereto; a light source disposed proximate to said liquid crystal display means for illuminating same; a single power source for energizing said oscillator means, said divider means, said driving circuit means, and said light source; manually operable time correcting switches disposed externally to said electronic timepiece; switching circuit means adapted to selectively connect said time correcting switches to said divider circuit means when said switching circuit means is in a first mode for the selective correction of digital display of time by said time correcting switches, said switching circuit means being adapted to selectively connect at least one of said time correcting switches to said light source when said switching means is in a second mode for the selective actuation of said light source by said correcting switches; and control switch means connected to said switching circuit means for selecting one of said first and second modes.

2. An electronic timepiece as claimed in claim 1, wherein said driving circuit means includes booster circuit means for stepping up the lower voltage of said power source to a higher voltage, said booster circuit means being coupled to apply said higher voltage to said liquid crystal display means.

3. An electronic timepiece as claimed in claim 1, said liquid crystal display including FE-type liquid crystal display elements.

4. An electronic timepiece as claimed in claim 1, wherein said display means, oscillator means, and divider means are adapted to utilize one half or less the capacity of said power source over an extended period.

5. An electronic timepiece as claimed in claim 4, wherein said power source is a battery.

6. An electronic timepiece as claimed in claim 5, wherein said battery includes a potassium hydroxide electrolytic solution therein.

7. An electronic timepiece as claimed in claim 1, wherein said control switch means is a manually operable switch disposed externally on said timepiece.

* * * * *